United States Patent [19]

Marchese et al.

[11] 4,246,453

[45] Jan. 20, 1981

[54] SWITCH

[75] Inventors: Justin W. Marchese, Belleville, N.J.; Daniel R. von Recklinghausen, Arlington, Mass.

[73] Assignee: Electro Audio Dynamics, Inc., Great Neck, N.Y.

[21] Appl. No.: 56,920

[22] Filed: Jul. 12, 1979

Related U.S. Application Data

[63] Continuation of Ser. No. 838,132, Sep. 30, 1977, abandoned.

[51] Int. Cl.[3] ..... H01H 19/54

[52] U.S. Cl. ..... 200/11 R; 200/11 DA; 200/291; 200/11 J

[58] Field of Search ..... 200/11 R, 11 A, 11 DA, 200/11 EA, 11 G, 11 J, 11 TW, 12, 14, 155 A, 290, 291, 292, 302, 303, 336

[56] References Cited

U.S. PATENT DOCUMENTS

| | | | |
|---|---|---|---|
| 1,707,784 | 4/1929 | Cawley | 200/11 J X |
| 2,908,777 | 10/1959 | Brown | 200/65 X |
| 2,924,680 | 2/1960 | Swenson | 200/12 X |
| 3,121,143 | 2/1964 | Landry et al. | 200/11 G |
| 3,198,894 | 8/1965 | Krug | 200/11 J X |
| 3,470,334 | 9/1969 | DeRobertis et al. | 200/11 R X |
| 3,699,279 | 10/1972 | Lockard et al. | 200/11 G |
| 3,718,786 | 2/1973 | Fila | 200/11 EA X |
| 3,809,830 | 5/1974 | Lockard et al. | 200/11 TW |
| 3,903,383 | 9/1975 | Marker | 200/11 TW |
| 3,958,087 | 5/1976 | Mol et al. | 200/11 TW X |
| 4,034,178 | 7/1977 | Koppenheffer et al. | 200/11 TW X |

FOREIGN PATENT DOCUMENTS

| | | | |
|---|---|---|---|
| 2504717 | 8/1976 | Fed. Rep. of Germany | 200/11 J |

*Primary Examiner*—James R. Scott
*Attorney, Agent, or Firm*—Alexander C. Wilkie

[57] ABSTRACT

An improved multicontact switch is disclosed which has a molded plastic body supporting a molded plastic rotor. Metallic contacts are resiliently mounted on the rotor in position to engage and bridge a second set of contacts provided in the form of a printed circuit formed on an inner surface of the switch cover. A versatile multicontact switch pattern is obtained by an appropriate layout of the printed circuit contacts in combination with a particular mounting arrangement of the contacts on the switch rotor.

5 Claims, 8 Drawing Figures

Fig. 1.
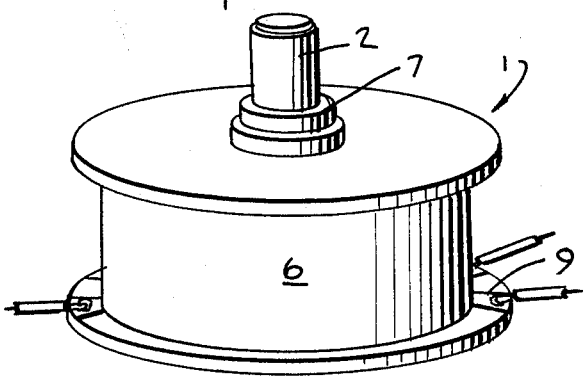
Fig. 5.
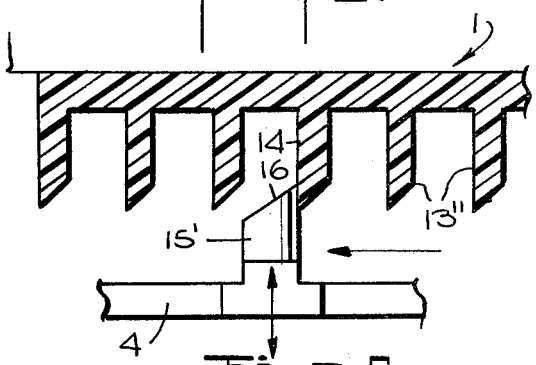
Fig. 6.
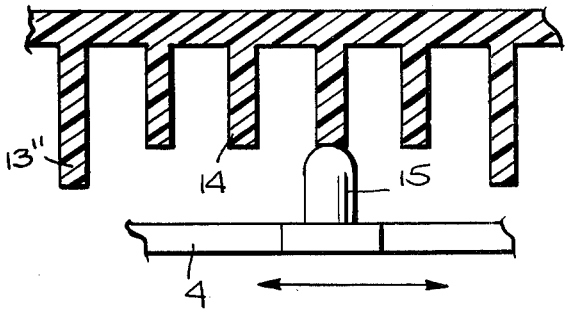
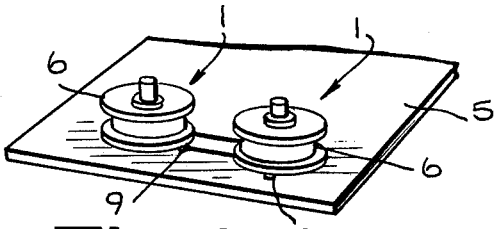
Fig. 8.
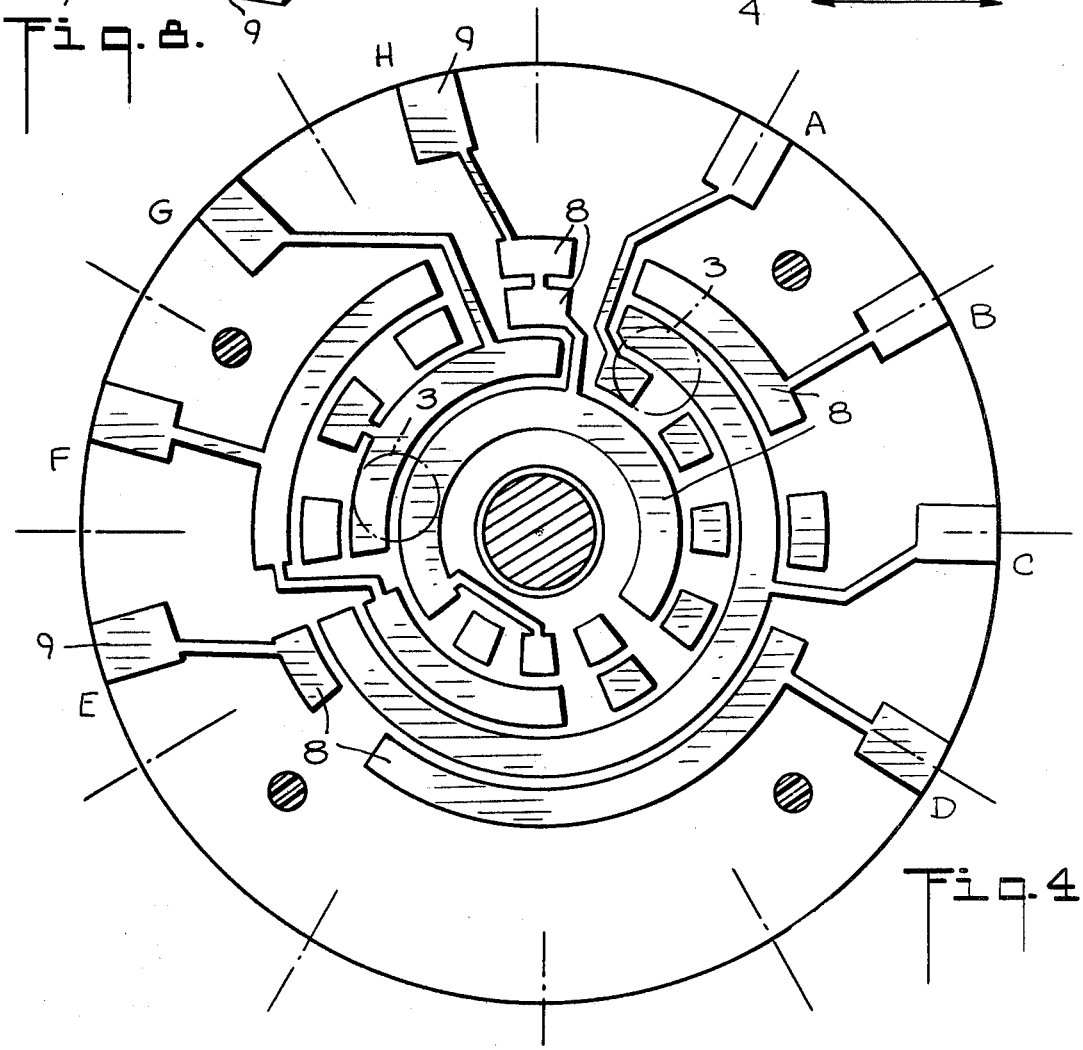
Fig. 4.

SWITCH

This is a continuation of application Ser. No. 838,132 filed Sept. 30, 1977, abandoned.

BACKGROUND OF THE INVENTION

The present invention relates to an improved multicontact switch and more particularly to a switch of the rotor or sliding type which is characterized by having one set of contacts formed as a printed circuit shaped for providing a particular switching sequence.

There are a variety of switching applications where a rotary or sliding switch is used for the selection of successive differing antenna arrays for differing television channels or for making similar circuit selections. These switching applications are characterized by the interconnection of a number of contacts in differing arrangements for successive switch arm or control knob positions. The presently known switches of this type are relatively complex due to the large number of contacts required and due to the differing connecting circuits required in the switching. Some of the known switches, for example, require the assembly of a stack array of stationary contact members whose individual contacts are engaged in various patterns by sliding or rotating contacts on the moving switch member. Such switches in one form or another require a relatively large amount of metal formed in intricate shapes and they also require a relatively complicated coupling or interwiring system for arranging the various switching combinations for the several switch positions.

The present invention provides a versatile, multicontact, multiposition switch for the uses referred to above which is formed of only a few molded plastic members together with a simplified contact arrangement formed of resiliently mounted contacts on one switch member and a cooperating array of second contacts formed as a printed circuit on another of the switch members.

Accordingly, an object of the present invention is to provide an improved multicontact and multiposition switch which is simple in form and which is easily manufactured with a variety of contact arrangements for the several switch positions.

Another object of the invention is to provide a relatively simple multicontact switch which is versatile for providing a variety of contact coupling arrangements.

Another object of the invention is to provide an improved multicontact and multiposition switch which is conveniently formed with molded plastic parts and with simplified metal contacts.

Another object of the invention is to provide an improved multiposition switch having a portion of its contacts formed as a printed circuit.

Another object of the invention is to provide an improved multiposition switch having a relatively large number of contacts and which is easily assembled.

Another object of the invention is to provide an improved multiposition switch having a simplified and versatile contact arrangement.

Another object of the invention is to provide an improved multicontact and multiposition switch having a minimum number of metal parts.

Another object of the invention is to provide an improved switch for antenna element selection.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWING

A preferred embodiment of the invention has been chosen for purposes of illustration and description and is shown in the accompanying drawings, forming a part of the specification, wherein:

FIG. 1 is a perspective view of a preferred embodiment of a switch in accordance with the present invention.

FIG. 4 is a horizontal sectional view of the switch body taken along line 4—4 on FIG. 2.

FIG. 5 is a vertical sectional view of an alternate embodiment of the detent arm.

FIG. 6 is a vertical sectional view of an alternate embodiment of the detent means.

FIG. 8 is a perspective view of an alternate embodiment with multiple switches.

DESCRIPTION OF THE PREFERRED EMBODIMENT

Figure 2:
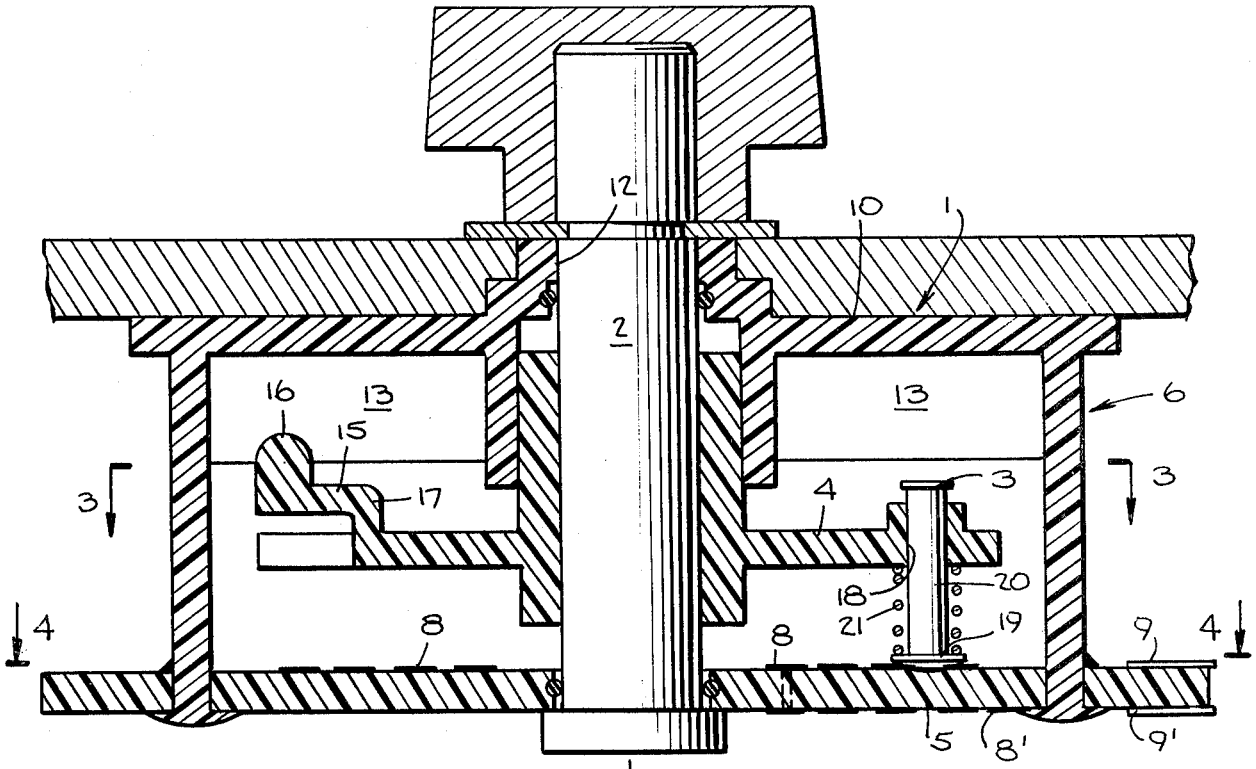
FIG. 2 is a vertical sectional view of the switch of FIG. 1.

A preferred embodiment of the switch will now be described with reference to the drawing which illustrates a rotary switch 1 in accordance with the invention. In the switch 1, the switching action is provided by a rotating shaft 2 which carries contacts 3 on a contact member 4 (FIG. 2) on a circular path along the stationary cover or contact plate 5. It is clear that in a differing embodiment, another means of carrying the moving contacts across the stationary contacts might be employed such as where the moving member may be mounted in a sliding relationship with a switch body.

FIG. 1 illustrates the assembled switch 1 whose principal parts are the unitary molded switch body 6 having a central bearing 7 mounting the shaft 2 for the moving contact member 4 (FIG. 2). The stationary contact plate 5 is attached to the body 6 at its open end in position so that contacts 8 on its inner surface are engaged by the moving contacts 3 resiliently mounted on the moving contact member 4.

The switch terminals 9 are positioned around the outer edge of the stationary contact plate 5 for attachment to the switched circuit or other switched elements.

Figure 3:
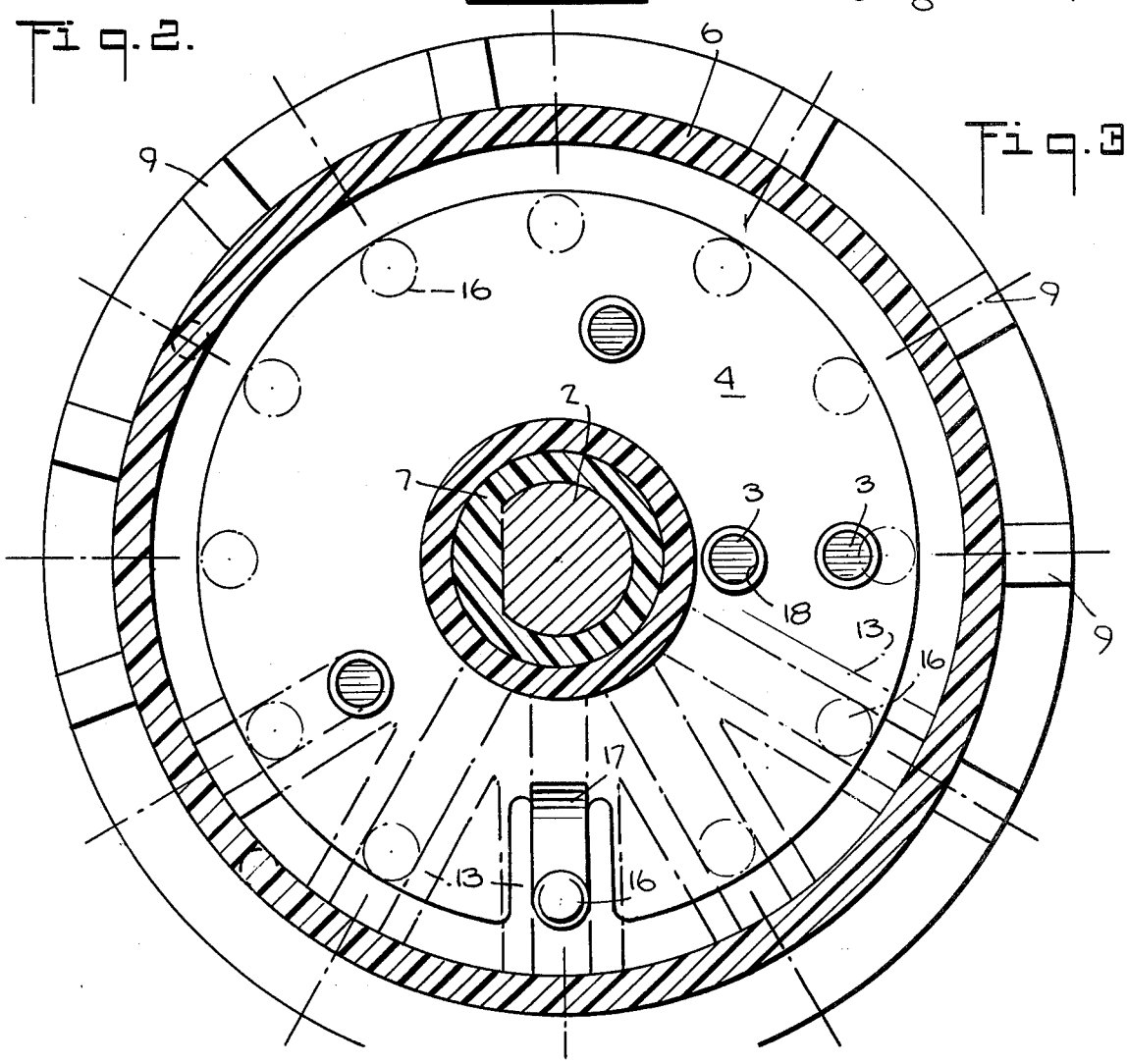
FIG. 3 is a horizontal sectional view of the switch body taken along line 3—3 on FIG. 2.
Figure 7:
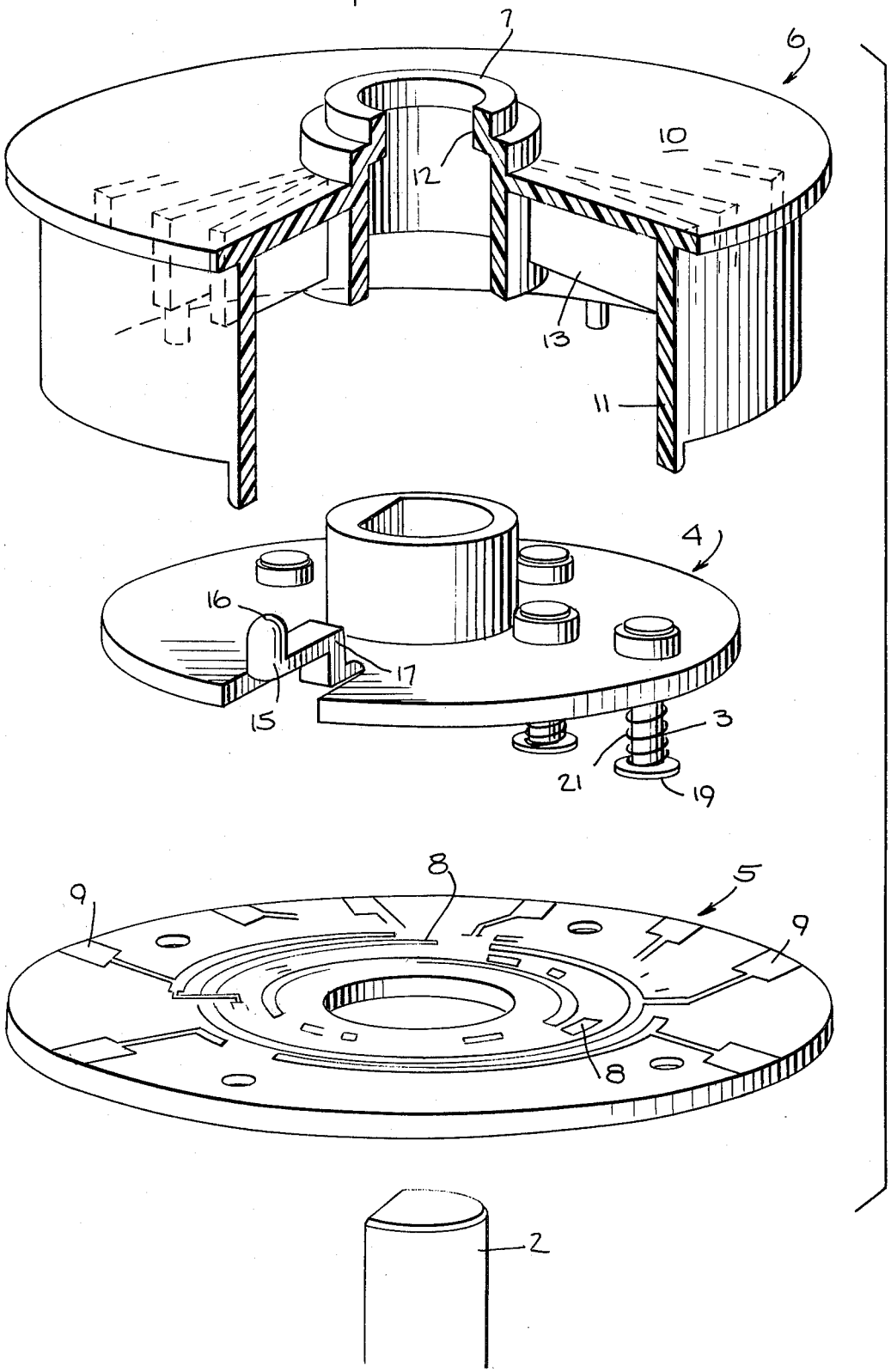
FIG. 7 is an exploded perspective view of the switch.

A preferred embodiment of the switch body is illustrated in FIGS. 2 and 3. The body 6 has a generally flat disc-like cover plate 10 with a circular surrounding flange 11. The bearing 7 is formed at the central portion of the cover plate 10 having bearing surfaces 12 for slidably supporting the switch shaft 2.

A number of generally radially extending partitions 13 are formed integrally with the switch body 6 which simultaneously strengthen the body 6 and also provide a series of radially spaced slots or detents 14 for engaging one or multiple detent arms 15 which may be arranged for balanced switching torque on the moving contact member 4.

As shown, the switch 1 may be rotated continuously in either direction through as many detented switch positions as the number of partitions 13 provide. By changes in the shape of partitions 13 and the detent arm 15, the switch rotation may be made unidirectional as shown by arm 15′ and partitions 13′ in FIG. 5. By increasing the height of one or two members 13, the number of switch positions may be limited to a predetermined number thereby preventing continuous rotation as shown by partitions 13″ in FIG. 6.

The switch shaft 2 and the moving contact member 4 positioned thereon may be formed as a molded integral unit or may be formed in two pieces comprising the shaft 2 and contact member 4. The contact member 4 includes the axially projecting detent arm 15 which is preferably formed of the same plastic material as the contact member 4 and having a rounded detent engaging projection 16 positioned to releasably engage the above described detents 14 in the switch body 6. The supporting portion 17 for the detent arm 15 is proportioned to flex thereby permitting the detent engaging projection 16 to move with a snap action from one detent 14 to another for the several switch positions. A number of apertures 18 are formed in the moving contact member 4 for mounting the metallic moving switch contacts 3. A preferred embodiment of the contacts 3 comprises rivet-like members with a contact head 19 and a mounting body 20 which is slidably held within the apertures. A coil spring 21 or other spring member is held in compressed position between the contact head 19 and the moving contact member 4 to urge the moving contacts 3 towards the stationary contact plate 5.

The stationary switch contacts 8 are positioned on the contact plate 5 and preferably these are applied as a printed or etched circuit. The particular shape for contacts 8 is designed to provide the necessary switching action and the overall contact pattern is formed by known printed circuit techniques. The positioning and the size of the moving contacts 3 is determined to cause them to bridge or connect the various adjacent stationary contact members as the moving contact member 4 is switched from one position to another.

FIG. 4 illustrates a typical pattern for the stationary contacts 8, such as might be used for switching a number of antenna elements to select various combinations of the elements. In this representative application, for example, the switch 1 would be used with a television indoor antenna so that the viewer might select one of several differing arrangements of the antenna elements for differing conditions for television channels. Thus, in the position shown in dash-dot lines for the moving contacts 8, terminals A and C are coupled together as also are terminals H and G. It will be seen that a large variety of other contact arrangements may be obtained by a suitable positioning of stationary contacts 8 with regard to the positions of the moving contacts 3 as they move around their circular paths from one switch position to another.

As described above, the switch 1 is seen to comprise relatively few parts which are easily produced by molding and by known circuit etching techniques.

If desired, the connecting wires between contacts 8 and terminals 9 may be recessed by pressing them into the base material of plate 5 to prevent contact by moving contacts 3 and the resulting wear.

Additional switch circuit flexibility may be obtained by making additional connections between the contacts 8 and the terminals by using the outside (bottom) surface of the contact plate 5 employing double clad printed circuit laminates with plate through holes or similar well known production techniques as seen at 9′ in FIG. 2. This permits the switch to be easily assembled by a method requiring only a few steps wherein the shaft 2 and the moving contact members 3 are inserted into the switch body 6. The desired number of moving contacts 3 are simply inserted into the apertures 18 against the force of the contact pressure springs 21 while the stationary contact plate 5 is slipped into place and is fastened to the body 6 by plastic welding or other known plastic adhering techniques. With the easily produced stationary contact 8 patterns obtained by the printed circuit technique and with the use of the preferred moving contact 3 arrangement, an almost infinite number of switching patterns is readily obtained resulting in a simple, rugged, inexpensive, and versatile switch.

The present switch design has all critical switch functions occurring in a closed protected volume provided by contact plate 5 and the abutting unitary switch body 6 thereby providing protection from dust, dirt, and other mechanical damage due to handling or wiring. Further protection from corrosive or explosive atmosphere is obtained by the use of seals such as elastomer O-rings between shaft 2 and the central bearing holes and contact plate 5 and by the addition of sealing compound elastomer or adhesives at the juncture of the switch body 6 and contact plate 5.

The switch plastic portions may be formed of known plastics used for molded electrical devices or elements with Delryn or a related plastic being satisfactory. The moving contacts 3 are formed of conducting metals, such as plated brass or other metals coated with highly conducting materials at the contact surfaces. The printed circuit for the contacts 8 is formed of the usual printed circuit materials.

Multiple switches may be formed by extending the common contact plate 5 to encompass the circuits for multiple switch assemblies, each containing a separate switch body 6, shaft 2, etc. An interconnection between switches 1 may be formed on contact plate 5 and additional circuit elements may be attached to the contact plate using known techniques to form the desired circuit and circuit modules as seen in FIG. 8.

It will therefore be seen that an improved switch adapted for multicontact, multichannel use has been provided which is rugged, easily manufactured, inexpensive, and versatile. These characteristics adapt the switch for numerous uses in electrical switching including antenna switching applications, television channel or related circuit switching applications, and a variety of other uses requiring the simultaneous switching of a number of outlet or circuit points.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

Having thus described our invention, we claim:

1. A switch comprising the combination of a hollow switch body, a contact plate attached to said hollow switch body, a movable contact mounting member including a shaft movably mounted on said hollow switch body, a printed circuit formed on a surface of said contact plate having a plurality of fixed contacts, said movable contact mounting member having a plurality of apertures for movable contacts therein, a movable contact mounted in each of said apertures and positioned for being moved by said contact mounting member into bridging relationship with pairs of fixed contacts of said printed circuit, said movable contacts comprising metal members each having a pair of spaced projections and being slidably positioned in said apertures between said spaced projections, springs positioned around said movable contacts between said contact mounting member and one of said projections for urging said movable contacts against said fixed contacts, said hollow switch body having a plurality of integral detents, and the contact mounting member having an integral detent engaging arm positioned for engaging said detents for positioning said movable contacts with respect to said fixed contacts.

2. The switch as claimed in claim 1 in which a portion of said printed circuit is recessed into said contact plate.

3. The switch as claimed in claim 1 which further comprises a portion of said printed circuit being formed on a second surface of said contact plate.

4. The switch as claimed in claim 1 in which said switch body and said contact plate comprise a closed volume.

5. The switch as claimed in claim 1 which further comprises means on said detents and on said detent engaging arms for limiting their relative motion in one direction.

* * * * *